US011224298B2

(12) United States Patent
Tuckey

(10) Patent No.: US 11,224,298 B2
(45) Date of Patent: Jan. 18, 2022

(54) CHILD CARRIER

(71) Applicant: Wonderland Switzerland AG, Steinhausen (CH)

(72) Inventor: Peter R. Tuckey, Leola, PA (US)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 16/868,563

(22) Filed: May 7, 2020

(65) Prior Publication Data

US 2020/0352349 A1 Nov. 12, 2020

Related U.S. Application Data

(60) Provisional application No. 62/844,948, filed on May 8, 2019, provisional application No. 62/884,283, filed on Aug. 8, 2019.

(51) Int. Cl.

| | |
|---|---|
| ***A47D 1/10*** | (2006.01) |
| ***A47D 1/00*** | (2006.01) |
| ***A47D 1/04*** | (2006.01) |

(52) U.S. Cl.

CPC ..... *A47D 1/006* (2013.01); *A47D 1/002* (2013.01); *A47D 1/0083* (2017.05); *A47D 1/04* (2013.01)

(58) Field of Classification Search

CPC ..... A47D 1/10; A47D 1/004
USPC ..... 297/451.8, 130, 148
See application file for complete search history.

(56) References Cited

U.S. PATENT DOCUMENTS

| | | | | |
|---|---|---|---|---|
| 8,602,490 | B2 * | 12/2013 | Tsai | A47D 1/00 297/130 |
| 8,794,703 | B2 * | 8/2014 | Bateman | A47C 4/028 297/344.18 |
| 2013/0241248 | A1 * | 9/2013 | Kostyniak | A47D 1/10 297/130 |
| 2016/0174727 | A1 | 6/2016 | Haut | |
| 2018/0279799 | A1 * | 10/2018 | Ingraham | B60N 2/2812 |
| 2021/0037989 | A1 * | 2/2021 | Rogers | A47D 1/004 |

FOREIGN PATENT DOCUMENTS

| | | | |
|---|---|---|---|
| CN | 107898216 | A | 4/2018 |
| CN | 108720426 | A | 11/2018 |

* cited by examiner

*Primary Examiner* — Sarah B McPartlin
(74) *Attorney, Agent, or Firm* — Winston Hsu

(57) ABSTRACT

A child carrier includes a booster seat and a leg assembly. The leg assembly is detachably installed on the booster seat. The leg assembly includes an upper support and a lower support. The upper support is detachably installed on the booster seat. The lower support is detachably installed on the upper support. The child carrier is in a high chair mode when the lower support and the upper support are respectively installed on the upper support and the booster seat to connect the leg assembly to the booster seat, the child carrier is in a youth chair mode when the upper support is installed on the booster seat and the lower support is detached from the upper support, and the child carrier is in a booster mode when the upper support is detached from the booster seat to separate the leg assembly from the booster seat.

15 Claims, 12 Drawing Sheets

CHILD CARRIER

CROSS REFERENCE TO RELATED APPLICATIONS

This application claims the benefit of U.S. Provisional Application No. 62/844,948, filed on May 8, 2019 and U.S. Provisional Application No. 62/884,283, filed on Aug. 8, 2019, and the entire contents of this application are hereby incorporated by reference.

BACKGROUND OF THE INVENTION

1. Field of the Invention

The present invention relates to a child product, and more particularly, to a child carrier which has simple structure and can be switched between with multiple using modes easily.

2. Description of the Prior Art

With development of the economy and advancement of the technology, there are more and more consumer goods for bringing convenience in people's life. A child carrier is one of the consumer goods. There are various types of child carriers available in the market, such as a child high chair or a child booster seat, and designed for accommodating children with different ages. A caregiver has to choose a right child carrier according to a child's age. Currently, there are some conventional child carriers switchable between different modes to accommodate children with different ages. However, such child carriers have complex structure and are not user-friendly enough. Therefore, there is a need to provide an improved child carrier which can be switched between with multiple using modes easily for accommodating children with different ages and/or in different activities.

SUMMARY OF THE INVENTION

It is an objective of the present invention to provide a child carrier which has simple structure and can be switched between with multiple using modes easily for solving the aforementioned problem.

In order to achieve the aforementioned objective, the present invention discloses a child carrier. The child carrier includes a booster seat and a leg assembly. The leg assembly is detachably installed on the booster seat. The leg assembly includes at least one upper support and at least one lower support. The at least one upper support is detachably installed on the booster seat. The at least one lower support is detachably installed on the at least one upper support. The child carrier is in a high chair mode when the at least one lower support and the at least one upper support are respectively installed on the at least one upper support and the booster seat to connect the leg assembly to the booster seat, the child carrier is in a youth chair mode when the at least one upper support is installed on the booster seat and the at least one lower support is detached from the at least one upper support, and the child carrier is in a booster mode when the at least one upper support is detached from the booster seat to separate the leg assembly from the booster seat.

According to an embodiment of the present invention, the at least one lower support includes at least one first segment and at least one second segment detachably installed on the at least one first segment.

According to an embodiment of the present invention, the leg assembly further includes at least one wheel rotatably disposed the at least one second segment.

According to an embodiment of the present invention, the at least one second segment includes two second segments, and the two second segments are connected to each other to cooperatively form a U-shaped structure.

According to an embodiment of the present invention, the child carrier further includes a releasing module for allowing or restraining at least one of movement of the at least one second segment relative to the at least one first segment, movement of the at least one lower support relative to the at least one upper support and movement of the at least one upper support relative to the booster seat.

According to an embodiment of the present invention, the child carrier further includes a leg rest detachably installed on the at least one upper support and a leg rest releasing assembly for allowing or restraining movement of the leg rest relative to the at least one upper support.

According to an embodiment of the present invention, the child carrier further includes a tray detachably installed on the booster seat and a tray releasing assembly for allowing or restraining movement of the tray relative to the booster seat.

According to an embodiment of the present invention, the child carrier further includes at least one guiding portion, and the at least one guiding portion is for guiding movement of the at least one lower support relative to the at least one upper support or movement of the at least one upper support relative to the booster seat.

According to an embodiment of the present invention, the child carrier further includes a seatback detachably installed on the booster seat.

According to an embodiment of the present invention, the seatback is rotatable relative to the booster seat.

According to an embodiment of the present invention, the seatback includes at least one pivoting protrusion and at least one retaining rib. At least one first slot and at least one second slot communicated with the at least one first slot are formed on the booster seat. The at least one pivoting protrusion and the at least one retaining rib are accommodated in the at least one first slot when the seatback is located at an unused position relative to the booster seat, and the at least one pivoting protrusion and at least a portion of the at least one retaining rib are respectively accommodated in the at least one first slot and the at least one second slot when the seatback is located at a used position relative to the booster seat.

According to an embodiment of the present invention, the at least one pivoting protrusion is a cylinder-shaped structure.

According to an embodiment of the present invention, the at least one retaining rib is an arc-shaped structure.

According to an embodiment of the present invention, the child carrier further includes a seatback releasing assembly for allowing or restraining a rotary movement of the seatback relative to the booster seat.

According to an embodiment of the present invention, the child carrier further includes a seatback restraining assembly for allowing or restraining separation of the seatback and the booster seat.

According to an embodiment of the present invention, the booster seat is a one-piece molded structure.

In order to achieve the aforementioned objective, the present invention further discloses a child carrier. The child carrier includes a booster seat and a leg assembly. The booster seat is a one-piece molded structure. The leg assembly is detachably installed on the booster seat. The leg assembly includes at least one upper support and at least one lower support. The at least one upper support is detachably installed on the booster seat. The at least one lower support is detachably installed on the at least one upper support. The child carrier is in a high chair mode when the at least one lower support and the at least one upper support are respectively installed on the at least one upper support and the booster seat to connect the leg assembly to the booster seat, the child carrier is in a youth chair mode when the at least one upper support is installed on the booster seat and the at least one lower support is detached from the at least one upper support, and the child carrier is in a booster mode when the at least one upper support is detached from the booster seat to separate the leg assembly from the booster seat.

In summary, the present invention allows a caregiver to switch the child carrier among the high chair mode, the youth chair mode and the booster mode by detaching the lower support only or detaching the upper supports together with the lower supports, so as to position the booster seat at different desired heights. Besides, the present invention further allows the caregiver to install or remove at least one of the seatback, the tray and the leg rest to provide different features to satisfy the child's needs no matter when the child carrier is in the high chair mode, the youth chair mode or the booster mode. Therefore, the present invention is not only user-friendly but also flexible in use.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
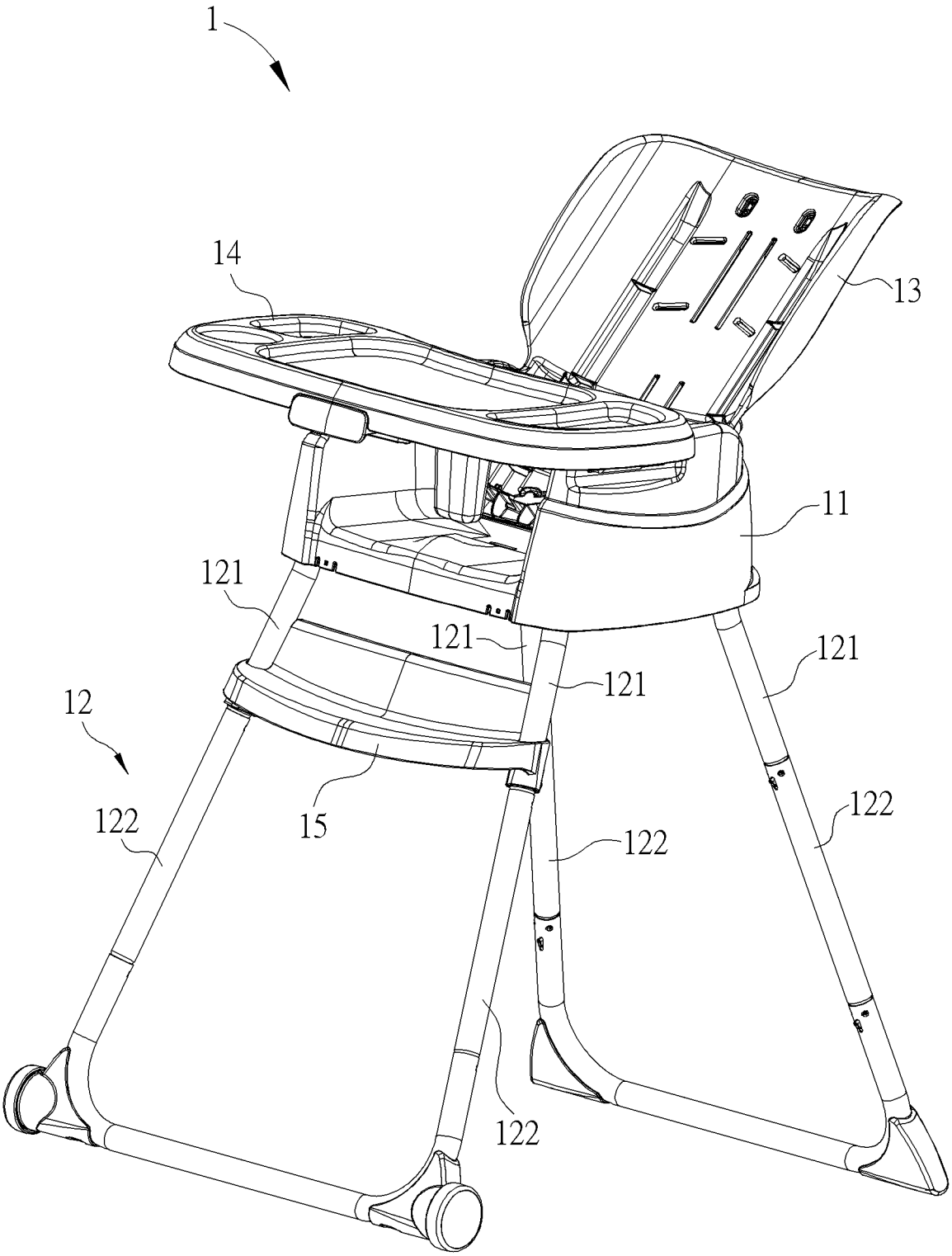
FIG. 1 is a schematic diagram of a child carrier in a high chair mode according to an embodiment of the present invention.
Figure 2:
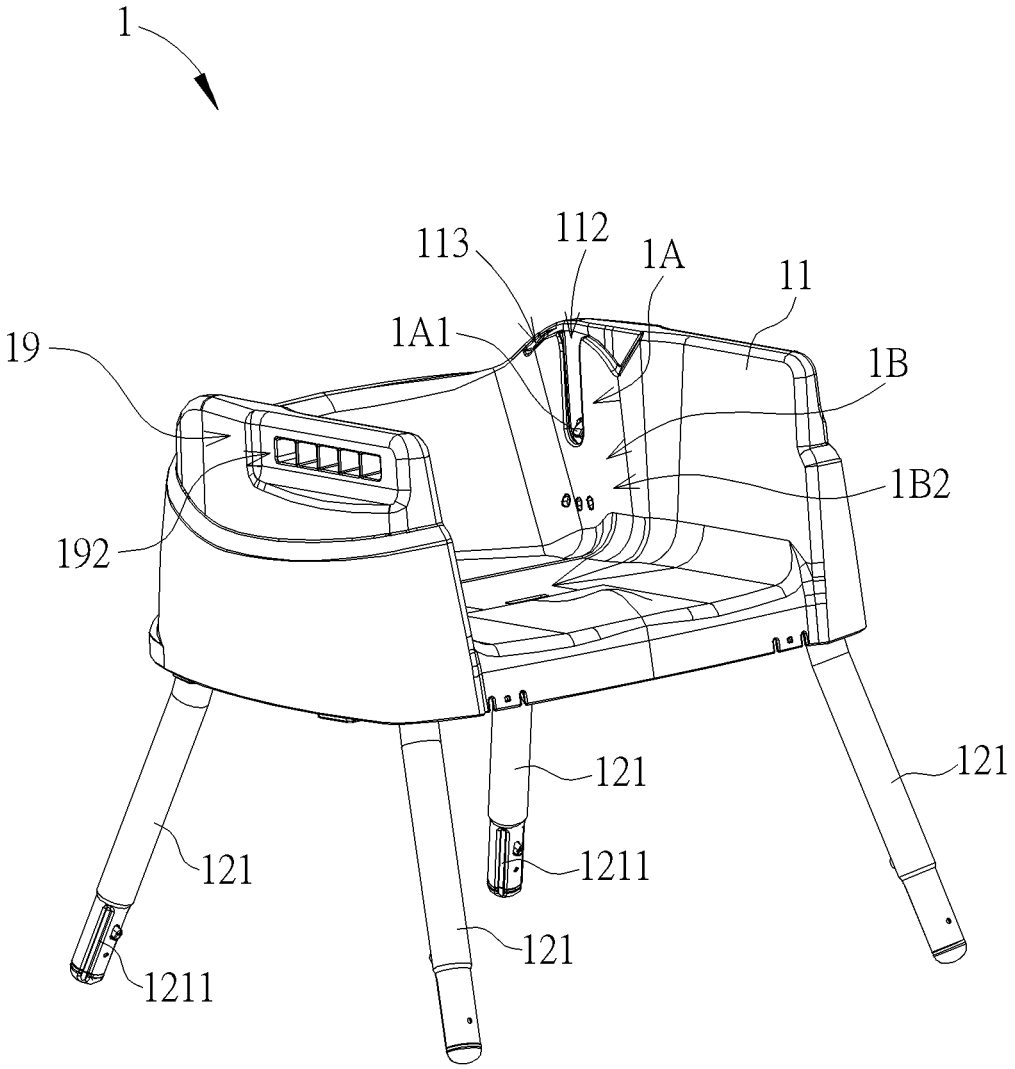
FIG. 2 to FIG. 4 are schematic diagrams of the child carrier in a youth chair mode with different features according to the embodiment of the present invention.
Figure 3:
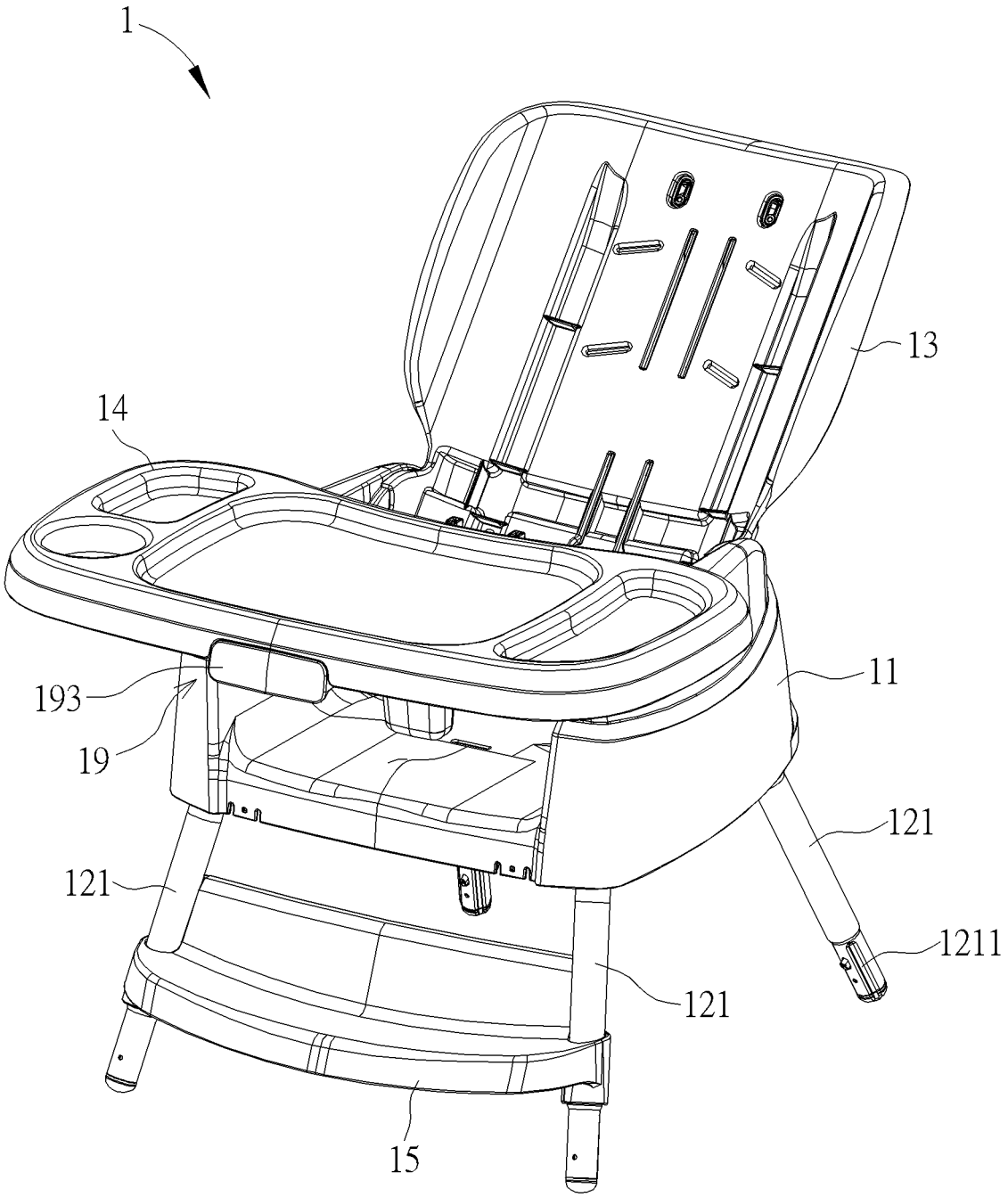
Figure 4:
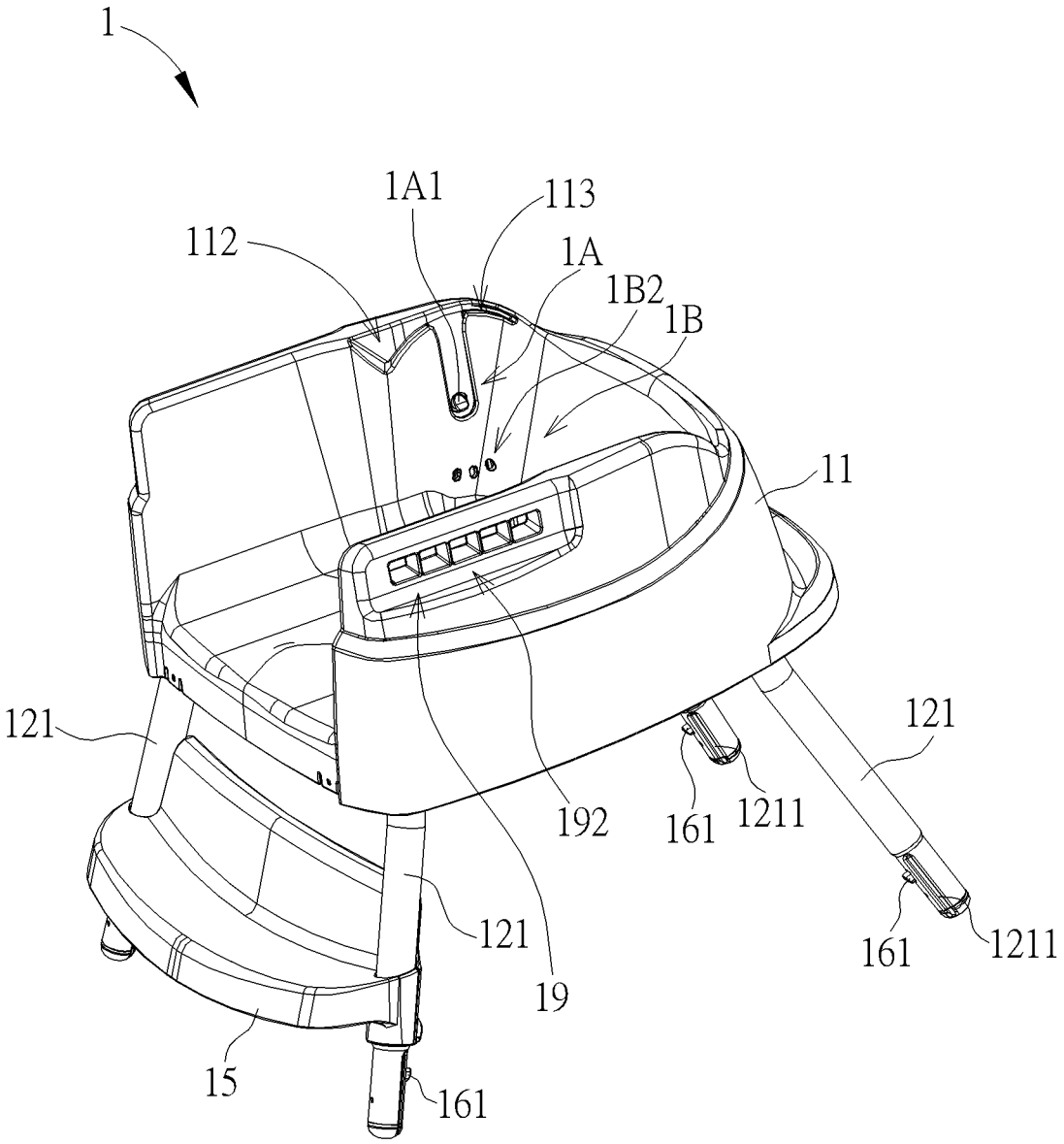
Figure 5:
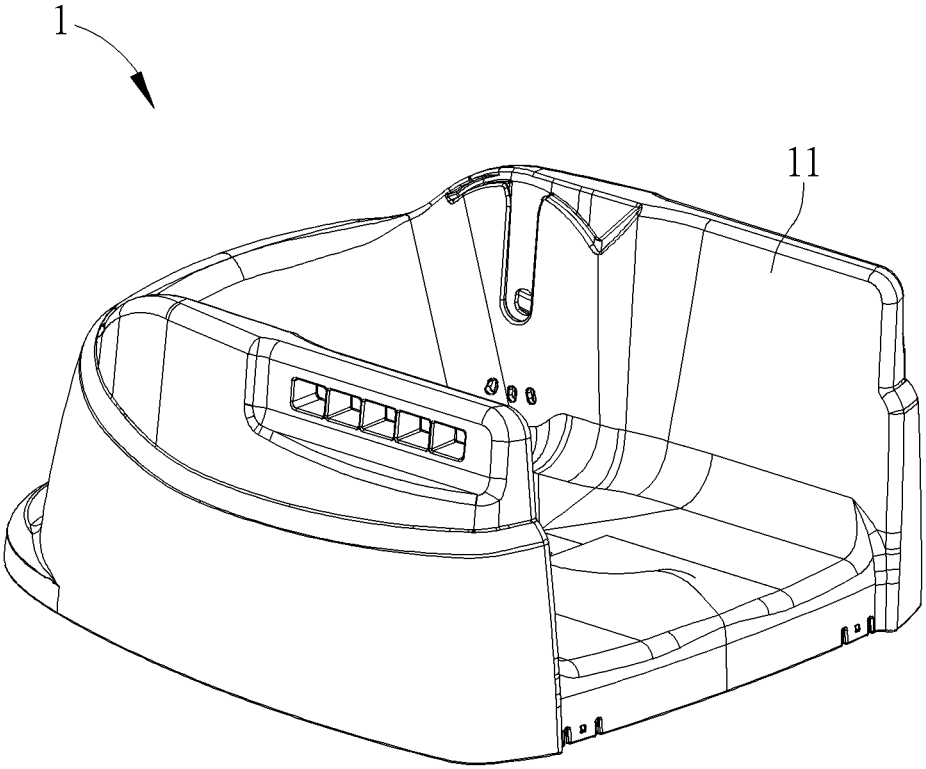
FIG. 5 is a schematic diagram of the child carrier in a booster mode according to the embodiment of the present invention.
Figure 6:
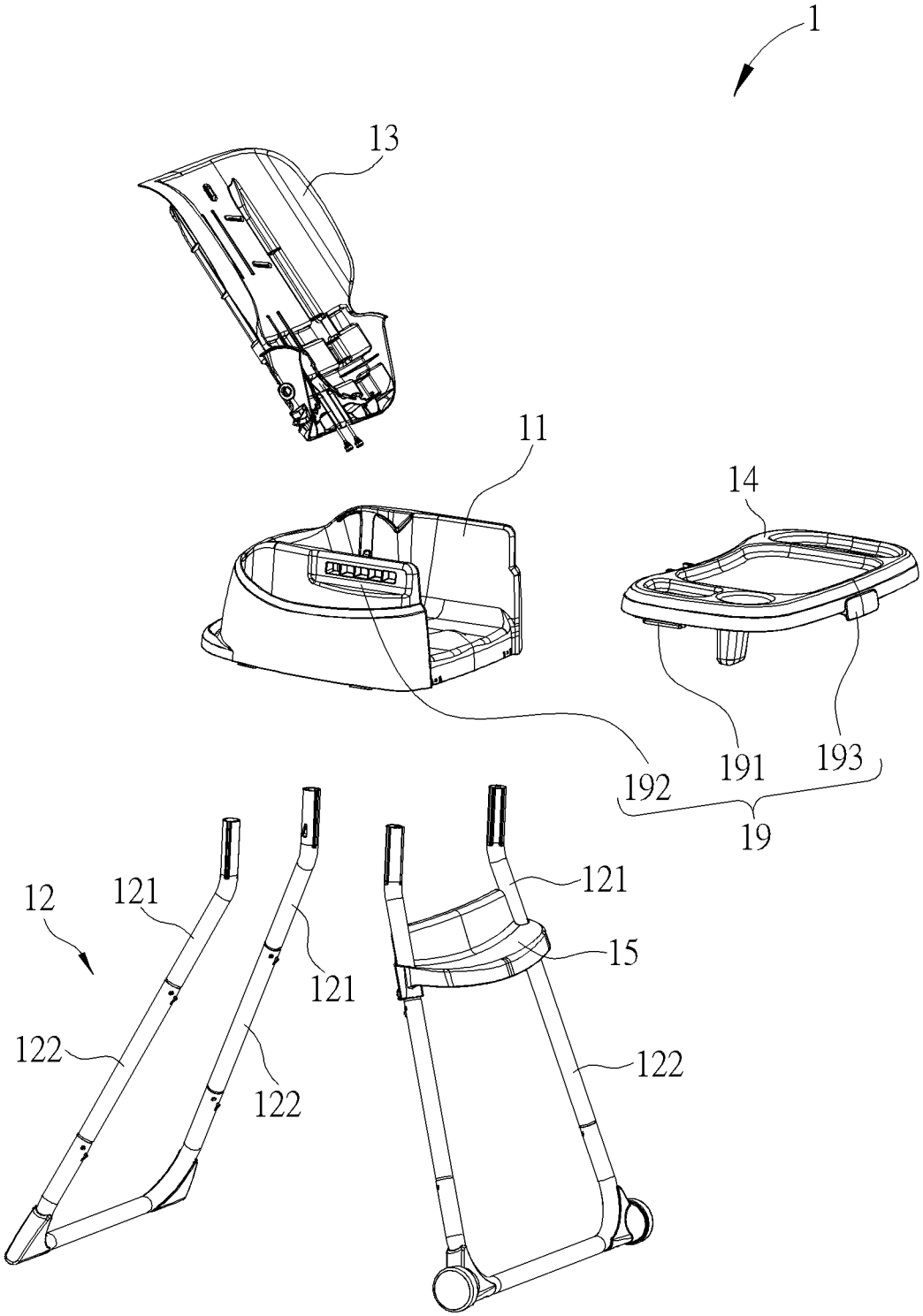
FIG. 6 is an exploded diagram of the child carrier according to the embodiment of the present invention.

Please refer to FIG. 1 to FIG. 6. FIG. 1 is a schematic diagram of a child carrier 1 in a high chair mode according to an embodiment of the present invention. FIG. 2 to FIG. 4 are schematic diagrams of the child carrier 1 in a youth chair mode with different features according to the embodiment of the present invention. FIG. 5 is a schematic diagram of the child carrier 1 in a booster mode according to the embodiment of the present invention. FIG. 6 is an exploded diagram of the child carrier 1 according to the embodiment of the present invention. As shown in FIG. 1 to FIG. 6, the child carrier 1 includes a booster seat 11, a leg assembly 12, a seatback 13, a tray 14 and a leg rest 15. The booster seat 11 is for accommodating a child. The leg assembly 12 is detachably installed on the booster seat 11 for supporting the booster seat 11. The leg assembly 12 includes four upper supports 121 and four lower supports 122. Each upper support 121 is detachably installed on the booster seat 11. Each lower support 122 is detachably installed on the corresponding upper support 121. The seatback 13 is detachably installed on the booster seat 11 and rotatable relative to the booster seat 11 for supporting the child's back. The tray 14 is detachably installed on the booster seat 11 for supporting the child's goods, such as food and beverages. The leg rest 15 is detachably installed on the leg assembly 12 for supporting the child's legs.

Preferably, in this embodiment, the booster seat 11 can be a one-piece molded structure for implementing a goal of simplicity for both a manufacturer and a caregiver while still providing adequate strength and accommodating ergonomic requirements. The four upper supports 121 and the four lower supports 122 are separated structures. However, the present invention is not limited thereto. For example, in another embodiment, there can be only one upper support and one lower support detachably installed on the upper support. It depends on practical demands.

The present invention allows the caregiver to switch the child carrier 1 among the high chair mode, the youth chair mode and the booster mode by detaching the four lower supports 122 only or detaching the four upper supports 121 together with the four lower supports 122, so as to position the booster seat 11 at different desired heights. Besides, the present invention further allows the caregiver to attach or remove at least one of the seatback 13, the tray 14 and the leg rest 15 to provide different features to satisfy the child's needs no matter when the child carrier 1 is in the high chair mode, the youth chair mode or the booster mode. Therefore, the present invention is not only user-friendly but also flexible in use.

For example, when it is desired to switch the child carrier 1 to the high chair mode as shown in FIG. 1, the four lower supports 122 and the four upper supports 121 can be respectively installed on the four upper supports 121 and the booster seat 11 to connect the leg assembly 12 to the booster seat 11, i.e., each lower support 122 and the corresponding upper support 121 are joined together, and each upper support 121 and the booster seat 11 are joined together.

Furthermore, the seatback 13 and the tray 14 can be installed on the booster seat 11, and the leg rest 15 can be installed on the two front upper supports 121. In this using mode, the caregiver can feed the child at a higher position.

When it is desired to switch the child carrier 1 to the youth chair mode as shown in FIG. 2, the four upper supports 121 can be installed on the booster seat 11, and the four lower supports 122 can respectively detached from the four upper supports 121. Furthermore, the seatback 13 and the tray 14 can be detached from the booster seat 11, and the leg rest 15 can be detached from the two front upper supports 121. In this using mode, the child can sit at a lower position without the leg rest 15.

When it is desired to switch the child carrier 1 to the youth chair mode as shown in FIG. 3, the four upper supports 121 can be installed on the booster seat 11, and the four lower supports 122 can respectively detached from the four upper supports 121. Furthermore, the seatback 13 and the tray 14 can be installed on the booster seat 11, and the leg rest 15 can be installed on the two front upper supports 121. In this using mode, the caregiver can feed the child at a lower position.

When it is desired to switch the child carrier 1 to the youth chair mode as shown in FIG. 4, the four upper supports 121 can be installed on the booster seat 11, and the four lower supports 122 can respectively detached from the four upper supports 121. Furthermore, the seatback 13 and the tray 14 can be detached from the booster seat 11, and the leg rest 15 can be installed on the two front upper supports 121. In this using mode, the child can sit at a lower position with the leg rest 15.

Besides, when it is desired to switch the child carrier 1 to the booster mode as shown in FIG. 5, the four upper supports 121 can be detached from the booster seat 11 to separate the leg assembly 12 from the booster seat 11. Furthermore, the seatback 13 and the tray 14 can be detached from the booster seat 11. In this using mode, the child carrier can be installed on an adult chair, and the child can sit on the booster seat 11 without the leg assembly 12.

Figure 7:
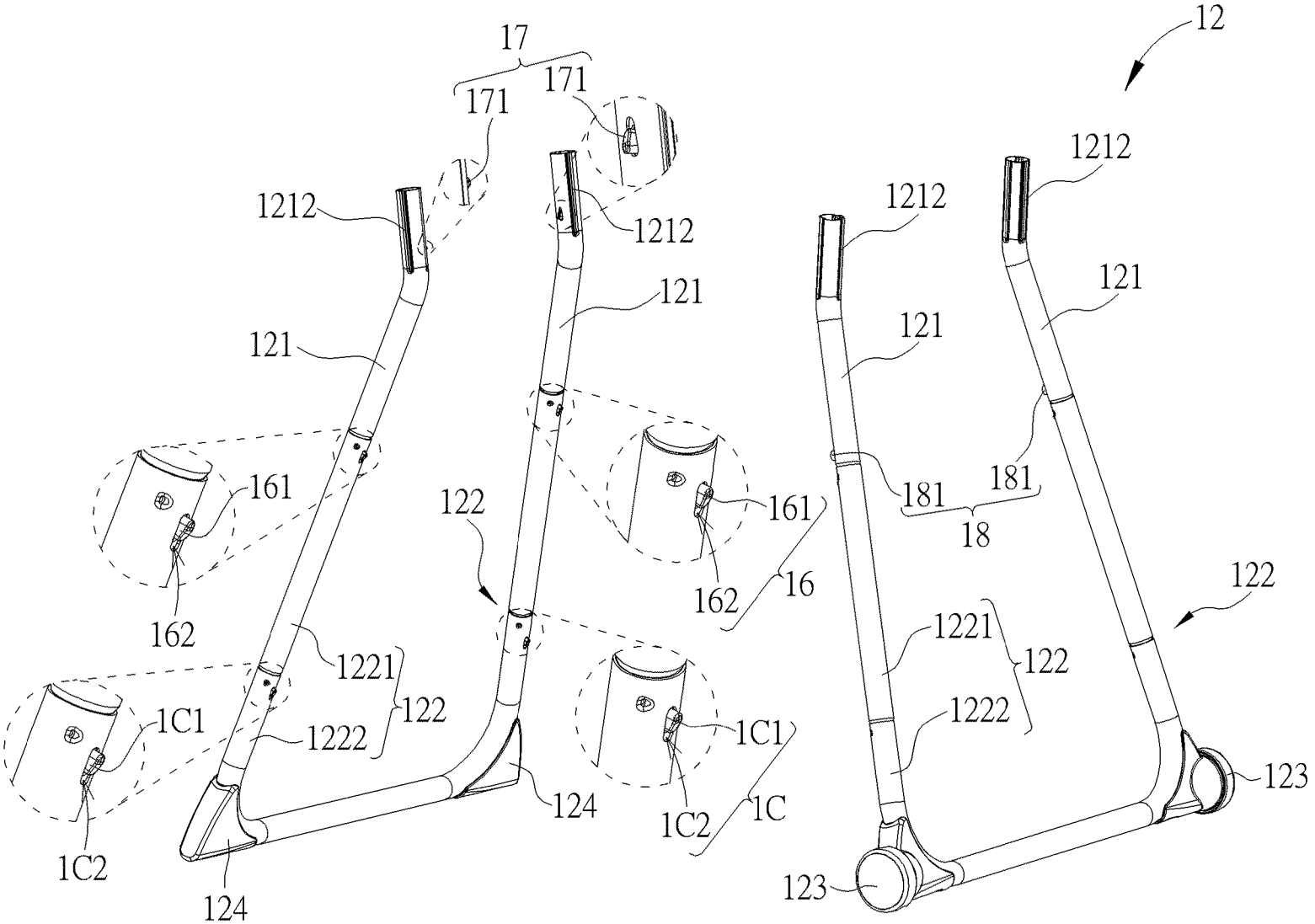
FIG. 7 is a diagram of a leg assembly according to the embodiment of the present invention.
Figure 12:
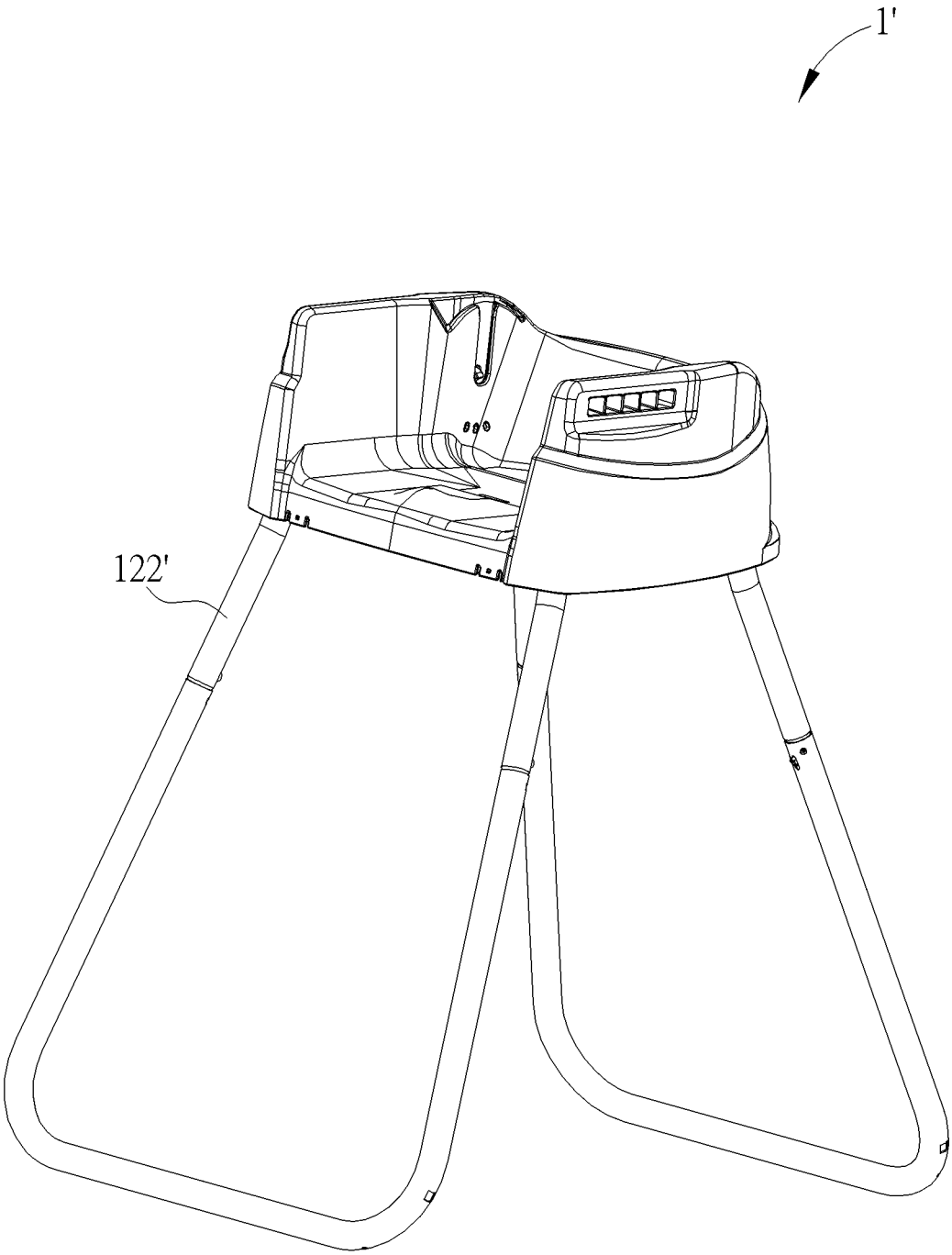
FIG. 12 is a schematic diagram of a child carrier in a high chair mode according to another embodiment of the present invention.

Please refer to FIG. 7. FIG. 7 is a diagram of the leg assembly 12 according to the embodiment of the present invention. As shown in FIG. 6 and FIG. 7, each lower support 122 includes a first segment 1221 and a second segment 1222. The second segment 1222 is detachably installed on the first segment 1221. Preferably, in this embodiment, the two front second segments 1222 are connected to each other to form a U-shaped structure, and the two rear second segments 1222 are connected to each other to form another U-shaped structure. Furthermore, in this embodiment, the leg assembly 12 can include two wheels 123 and two stands 124. The two wheels 123 are respectively rotatably disposed on the two front second segments 1222, and the two stands 124 are detachably installed on the two rear second segments 1222, so that it allows the caregiver to pull or drag the child carrier 1 in the high chair mode more easily. However, the present invention is not limited to this embodiment. For example, please refer to FIG. 12. FIG. 12 is a schematic diagram of a child carrier 1' in a high chair mode according to another embodiment of the present invention. As shown in FIG. 12, in this embodiment, the child carrier 1' includes two lower supports 122'. Each lower support 122' can be an integral structure, and there is no stand or wheel disposed on the lower support 122'.

Furthermore, the child carrier 1 further includes a releasing module. The releasing module includes a support releasing assembly 16 for allowing or restraining movement of the corresponding lower support 122 relative the corresponding upper support 121 and a segment releasing assembly 1C for allowing or restraining movement of the corresponding second segment 1222 relative to the corresponding first segment 1221. Specifically, the support releasing assembly 16 includes four support engaging components 161, four support engaging slot structures 162, and four support resilient components, which are not shown in the figures. The four support engaging components 161 are respectively movably disposed on the four upper supports 121. The four support engaging slot structures 162 are respectively formed on the four lower supports 122. The four support resilient components biases the four support engaging components 161 to engage with the four support engaging slot structures 162 respectively.

Similarly, the segment releasing assembly 1C includes four segment engaging components 1C1, four segment engaging slot structures 1C2, and four segment resilient components, which are not shown in the figures. The four segment engaging components 1C1 are respectively movably disposed on the four first segments 1221. The four segment engaging slot structures 1C2 are respectively formed on the four second segments 1222. The four segment resilient components biases the four segment engaging components 1C1 to engage with the four segment engaging slot structures 1C2 respectively.

As shown in FIG. 2 to FIG. 4 and FIG. 6 and FIG. 7, at least one first guiding portion 1211 is formed on a lower end of each upper support 121. At least one second guiding portion, which is not shown in the figures, is formed on an upper end of each lower support 122. The first guiding portion 1211 can cooperate with the second guiding portion to guide the movement of the lower support 122 relative to the upper support 121 to ensure the lower support 122 to be installed on the upper support 121 properly. Understandably, the lower support 122 includes a similar mechanism to guide the movement of the second segment 1222 relative to the first segment 1221. Detailed description is omitted herein for simplicity.

When it is desired to install the four lower supports 122 on the four upper supports 121, the four support engaging components 161 can be pressed to move inwardly to resiliently deform the four support resilient components, so that the four upper supports 121 can be inserted into the four lower supports 122 without any interference. When the four support engaging components 161 are respectively aligned with the four support engaging slot structures 162, the four resiliently deformed support resilient components can drive the four support engaging components 161 to engage with the four support engaging slot structures 162 respectively, so that the four lower supports 122 can respectively engage with the four upper supports 121 by engagement of the four support engaging components 161 and the four support engaging slot structures 162.

When it is desired to detach the four lower supports 122 from the four upper supports 121, the four support engaging components 161 can be pressed to move inwardly to respectively disengage from the four support engaging slot structures 162, so that the four upper supports 121 can be withdrawn from the four lower supports 122 without any interference.

Preferably, in this embodiment, an inclined surface can be formed on each support engaging component 161. By such configuration, each support engaging component 161 can be pressed by the corresponding lower support 122 during insertion of the corresponding upper support 121 into the corresponding lower support 122. The caregiver does not have to press the support engaging component 161 manually during the insertion of the upper support 121 into the lower support 122, which facilitates the insertion of the upper support 121 into the lower support 122.

Furthermore, the support resilient component can preferably be an elastic spring or torsional spring. However, the present invention is not limited thereto.

Figure 8:
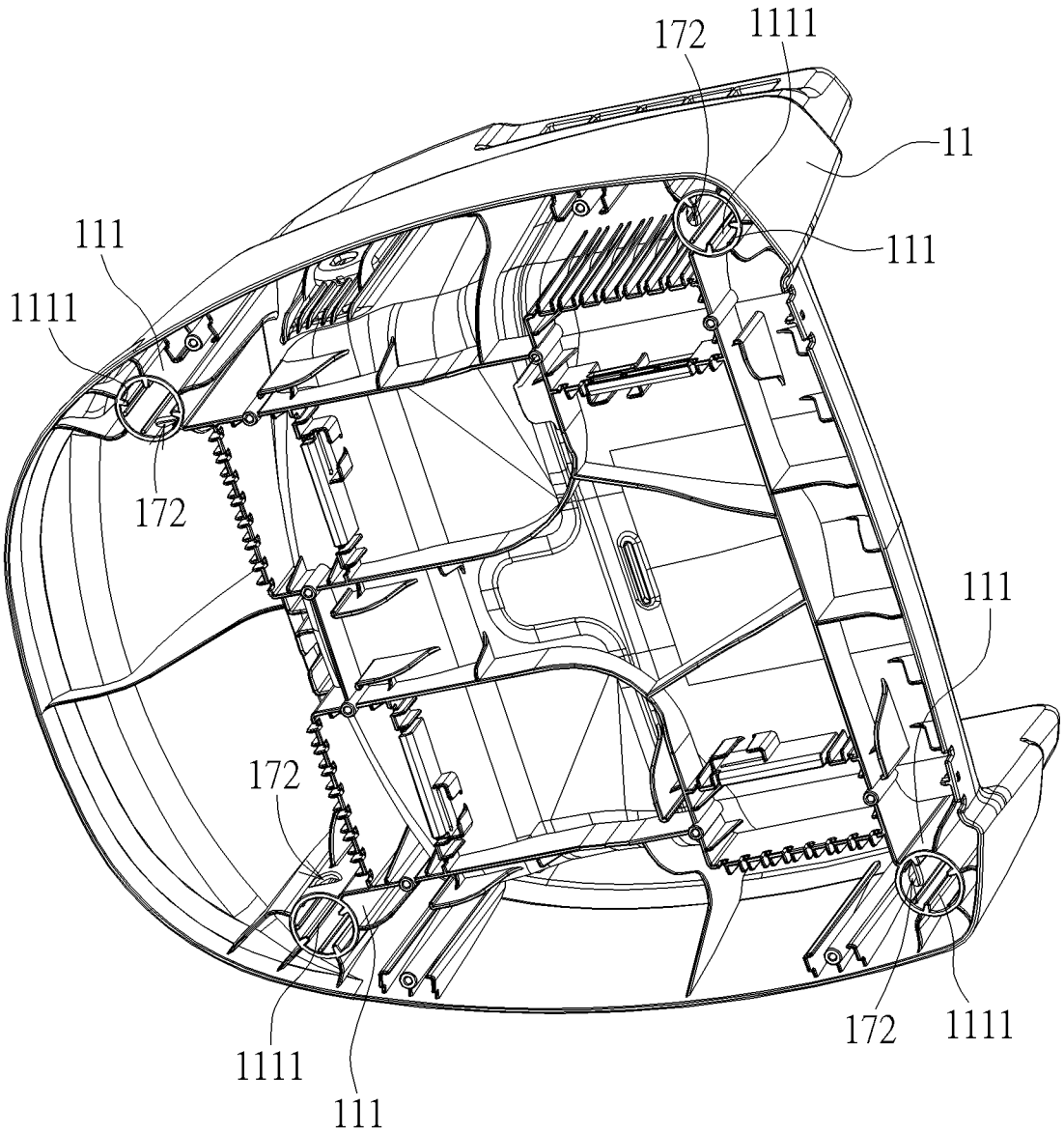
FIG. 8 is a partial internal structural diagram of a booster seat according to the embodiment of the present invention.

Please refer to FIG. 6 to FIG. 8. FIG. 8 is a partial internal structural diagram of the booster seat 11 according to the embodiment of the present invention. As shown in FIG. 6 to FIG. 8, the releasing module further includes a leg releasing assembly 17 for allowing or restraining movement of the four upper supports 121 relative the booster seat 11. Specifically, the leg releasing assembly 17 includes four leg engaging components 171, four leg engaging slot structures 172, and four leg resilient components, which are not shown in the figures. The four leg engaging components 171 are respectively movably disposed on the four upper supports 121. The four leg engaging slot structures 172 are respectively formed on four sockets 111 located on four corners of the booster seat 11. The four leg resilient components bias the four leg engaging components 171 to engage with the four leg engaging slot structures 172 respectively.

As shown in FIG. 6 to FIG. 8, at least one third guiding portion 1212 is formed on an upper end of each upper support 121. At least one fourth guiding portion 1111 is formed inside each socket 111. The third guiding portion 1212 can cooperate with the fourth guiding portion 1111 to guide the movement of the upper support 121 relative to the booster seat 11 to ensure the upper support 121 to be installed into the socket 111 properly.

When it is desired to install the four upper supports 121 on the booster seat 11, the four leg engaging components 171 can be pressed to move inwardly to resiliently deform the four leg resilient components, so that the four upper supports 121 can be inserted into the four sockets 111 without any interference. When the four leg engaging components 171 are respectively aligned with the four leg engaging slot structures 172, the four resiliently deformed leg resilient components can drive the four leg engaging components 171 to engage with the four leg engaging slot structures 172 respectively, so that the four upper supports 121 can engage with the booster seat 11 by engagement of the four leg engaging components 171 and the four leg engaging slot structures 172.

When it is desired to detach the four upper supports 121 from the booster seat 11, the four leg engaging components 171 can be pressed to move inwardly to respectively disengage from the four leg engaging slot structures 172, so that the four upper supports 121 can be withdrawn from the four sockets 111 without any interference.

Preferably, in this embodiment, an inclined surface can be formed on each leg engaging component 171. By such configuration, each leg engaging component 171 can be pressed by the corresponding socket 111 during insertion of the corresponding upper support 121 into the booster seat 11. The caregiver does not have to press the leg engaging component 171 manually during the insertion of the upper support 121 into the booster seat 11, which facilitates the insertion of the upper support 121 into the booster seat 11.

Furthermore, the leg resilient component can preferably be an elastic spring or torsional spring. However, the present invention is not limited thereto.

As shown in FIG. 6 to FIG. 8, the child carrier 1 further includes a leg rest releasing assembly 18 for allowing or restraining movement of the leg rest 15 relative to the two front upper supports 121. Specifically, the leg rest releasing assembly 18 includes two leg rest engaging components 181, two leg rest engaging slot structures, which are not shown in the figures, and two leg rest resilient components, which are not shown in the figures. The two leg rest engaging components 181 are respectively movably disposed on the two front upper supports 121. The two leg rest engaging slot structures are respectively formed on two lateral sides of the leg rest 15. The two leg rest resilient components bias the two leg rest engaging components 181 to engage with the two leg rest engaging slot structures respectively.

When it is desired to install the leg rest 15 on the two front upper supports 121, the two leg rest engaging components 181 can be pressed to move inwardly to resiliently deform the two leg resilient components, so that the leg rest 15 can be sleeved on the two front upper supports 121 without any interference. When the two leg rest engaging components 181 are respectively aligned with the two leg rest engaging slot structures, the two resiliently deformed leg rest resilient components can drive the two leg rest engaging components 181 to engage with the two leg lest engaging slot structures respectively, so that the leg rest 15 can engage with the two front upper supports 121 by engagement of the two leg rest engaging components 181 and the two leg rest engaging slot structures.

When it is desired to detach the leg rest 15 from the two front upper supports 121, the two leg rest engaging components 181 can be pressed to move inwardly to respectively disengage from the two leg rest engaging slot structures, so that the leg rest 15 can be removed from the two front upper supports 121 without any interference.

Preferably, in this embodiment, an inclined surface can be formed on each leg rest engaging component 181. By such configuration, each leg rest engaging component 181 can be pressed by the leg rest 15 during installation of the leg rest 15 onto the two front upper supports 121. The caregiver does not have to press the leg rest engaging component 181 manually during the installation of the leg rest 15 onto the two front upper supports 121, which facilitates the installation of the leg rest 15 onto the two front upper supports 121.

Furthermore, the leg rest resilient component can preferably be an elastic spring or torsional spring. However, the present invention is not limited thereto.

Please refer to FIG. 2 to FIG. 4 and FIG. 6. As shown in FIG. 2 to FIG. 4 and FIG. 6, the child carrier 1 further includes a tray releasing assembly 19 for allowing or restraining movement of the tray 14 and the booster seat 11. Specifically, the tray releasing assembly 19 includes two tray engaging components 191, a plurality of tray engaging slot structures 192, a tray resilient component, which is not shown in the figures, and a tray driving component 193. The two tray engaging components 191 are respectively movably disposed on two lateral sides of the tray 14. The plurality of tray engaging slot structures 192 are formed on two lateral sides of the booster seat 11. The tray driving component 193 is movably disposed on a front side of the tray 14 for driving the two tray engaging components 191 to respectively engage with or disengage from the two tray engaging slot structures 192. The tray resilient component biases the tray driving component 193 to drive the two tray engaging components 191 to respectively engage with the two tray engaging slot structures 192.

When it is desired to install the tray 14 on the booster seat 11, the tray driving component 193 can be operated to drive the two tray engaging components 191 to move to allow installation of the tray 14 without any interference. When the tray 14 is installed on the booster seat 11 and moved to a desired position, the tray driving component 193 can be released, so that the resiliently deformed tray resilient component can drive the tray driving component 193 to recover to drive the two tray engaging components 191 to respectively engage with the two tray engaging slot structures 192, so that the tray 14 can engage with the booster seat 11 by engagement of the two tray engaging components 191 and the two corresponding tray engaging slot structures 192.

When it is desired to adjust a position of the tray 14 relative to the booster seat 11, the tray driving component 193 can be operated to drive the two tray engaging components 191 to disengage from the two corresponding tray engaging slot structures 192 for allowing the movement of the tray 14 relative to the booster seat 11. When adjustment of the tray 14 is completed, the tray driving component 193 can be released to engage the two tray engaging components 191 with the two corresponding tray engaging slot structures 192 to position the tray 14.

When it is desired to detach the tray 14 from the booster seat 11, the tray driving component 193 can be operated to drive the two tray engaging components 191 to disengage from the two tray engaging slot structures 192, so that the tray 14 can be removed from the booster seat 11 without any interference.

Furthermore, the tray resilient component can preferably be an elastic spring or torsional spring. However, the present invention is not limited thereto.

Figure 9:
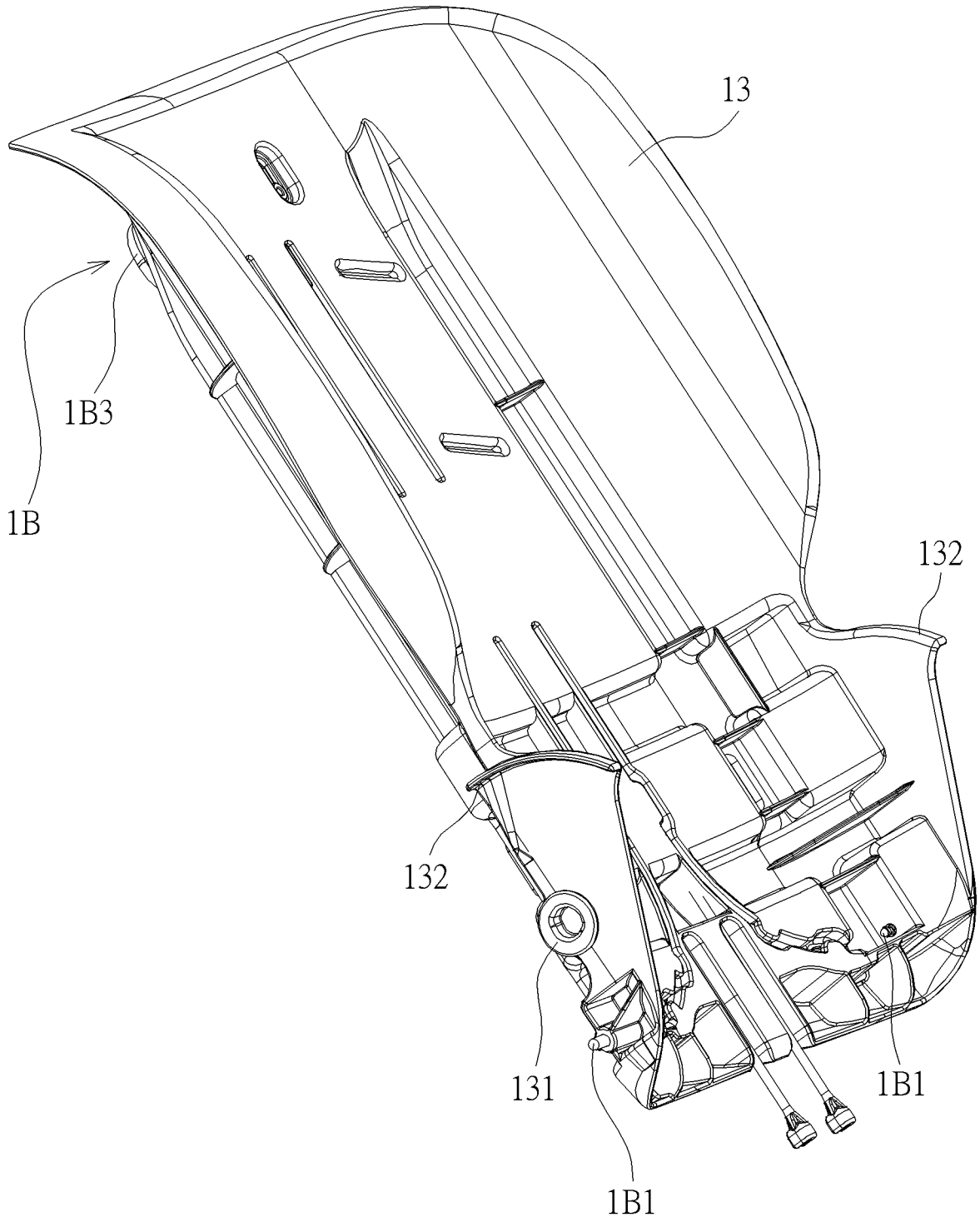
FIG. 9 is a diagram of a seatback according to the embodiment of the present invention.
Figure 10:
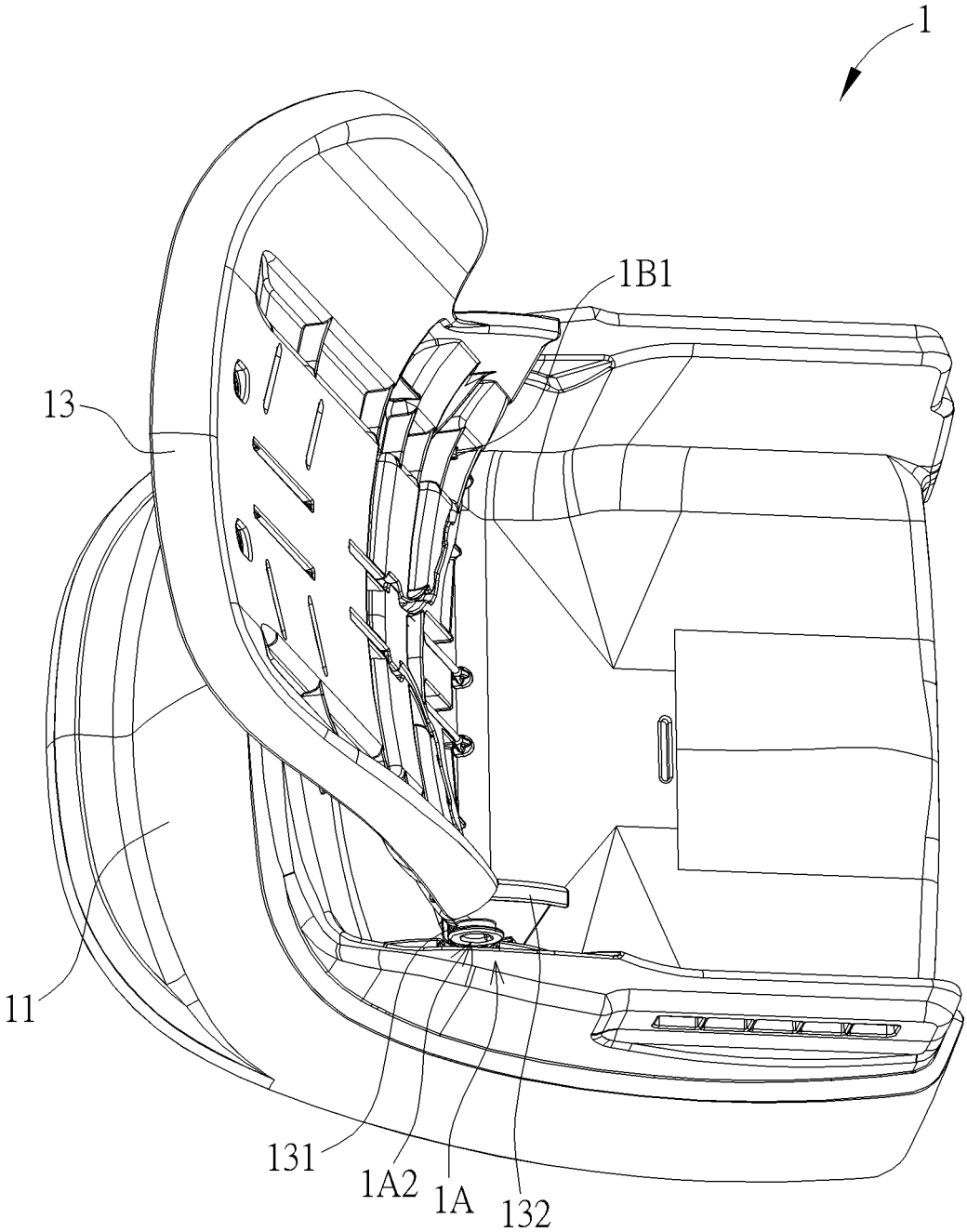
FIG. 10 is a partial diagram of the child carrier as the seatback has not been installed on the booster seat yet according to the embodiment of the present invention.
Figure 11:
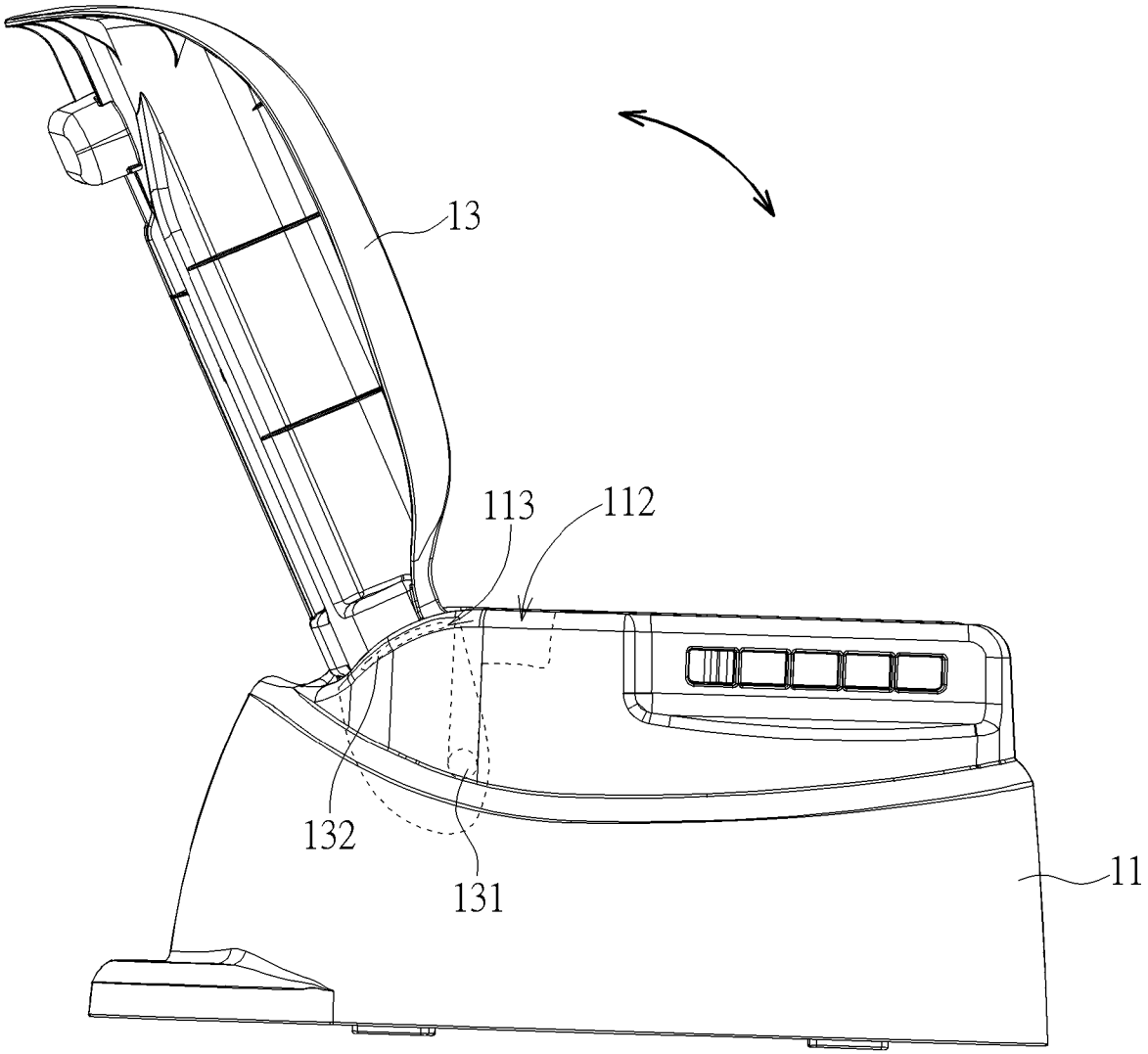
FIG. 11 is a partial diagram of the child carrier as the seatback is located at a used position according to the embodiment of the present invention.

Please refer to FIG. 2 to FIG. 4 and FIG. 9 to FIG. 11. FIG. 9 is a diagram of the seatback 13 according to the embodiment of the present invention. FIG. 10 is a partial diagram of the child carrier 1 as the seatback 13 has not been installed on the booster seat 11 yet according to the embodiment of the present invention. FIG. 11 is a partial diagram of the child carrier 1 as the seatback 13 is located at a used position according to the embodiment of the present invention. As shown in FIG. 2 to FIG. 4 and FIG. 9 to FIG. 11, the seatback 13 includes two pivoting protrusions 131 and two retaining ribs 132 at two lateral sides. A first slot 112 and a second slot 113 communicated with the first slot 112 are formed on each lateral side of the booster seat 11. Each first slot 112 is open toward an outer periphery of the booster seat 11, and each second slot 113 is not open toward the outer periphery of the booster seat 11. The two pivoting protrusions 131 and the two retaining ribs 132 are accommodated in the two first slots 112 for allowing separation of the seatback 13 and the booster seat 11 when the seatback 13 is located at an unused position relative to the booster seat 11. The two pivoting protrusions 131 are respectively accommodated in the two first slots 112, and the two retaining ribs 132 are respectively at least partially accommodated the two second slots 113, i.e., the pivoting protrusion 131 and at least a portion of the retaining rib 132 are located in different slots, for restraining the separation of the seatback 13 and the booster seat 11 when the seatback 13 is located at the used position relative to the booster seat 11.

Besides, the child carrier 1 further includes a seatback restraining assembly 1A for allowing or restraining the separation of the seatback 13 and the booster seat 11. Specifically, the seatback restraining assembly 1A includes two restraining components 1A1 and two restraining portions 1A2. The two restraining components 1A1 are movably disposed on the booster seat 11. The two restraining portions 1A2 are respectively formed on the two pivoting protrusions 131. The two restraining components 1A1 can be operated to engage with or disengage from the two restraining portions 1A2 for restraining or allowing the separation of the seatback 13 and the booster seat 11.

Preferably, in this embodiment, each pivoting protrusion 131 can be a cylinder-shaped structure, and each retaining rib 132 can be an arc-shaped structure. Furthermore, each first slot 112 can be an L-shaped structure, and each second slot 113 can be another arc-shaped structure corresponding to a shape of the corresponding retaining rib 132. However, the present invention is not limited to this embodiment. Furthermore, the numbers and the shapes of the pivoting protrusion 131, the retaining rib 132, the first slot 112 and the second slot 113 are not limited to this embodiment. For example, in another embodiment, there can be only one pivoting protrusion and one retaining rib at one side of the seatback, and one first slot and one second slot at one side of the booster seat.

Besides, preferably, in this embodiment, each restraining component 1A1 can be a protrusion, and each restraining portion 1A2 can be a recess. However, the present invention is not limited to this embodiment.

When it is desired to install the seatback 13 on the booster seat 11, the two pivoting protrusions 131 and the two retaining ribs 132 can be placed in the two first slots 112, so as to locate the seatback 13 at the unused position and engage the two restraining components 1A1 with the two restraining portions 1A2. Afterwards, the seatback 13 can be rotated from the unused position to the used position to move the two retaining ribs 132 at least partially into the two second slots 113 for preventing unintentional separation of the seatback 13 and the booster seat 11.

When it is desired to detach the seatback 13 from the booster seat 11, the seatback 13 has to be rotated to the unused position to move the two pivoting protrusions 131 and the two retaining ribs 132 in the two first slots 112. Afterwards, the two restraining components 1A1 can be operated to disengage from two restraining slot structures 1A2, so that the seatback 13 can be removed from the booster seat 11 without any interference.

Preferably, in this embodiment, an inclined surface can be formed on each restraining component 1A1 for facilitating the engaging operation of the restraining component 1A1 and the restraining portion 1A2.

As shown in FIG. 2 to FIG. 4 and FIG. 9 to FIG. 11, the child carrier 1 further includes a seatback releasing assembly 1B for allowing or restraining rotary movement of the seatback 13 relative to the booster seat 11. Specifically, the seatback releasing assembly 1B includes two seatback engaging components 1B1, a plurality of seatback engaging slot structures 1B2, a seatback resilient component, which is not shown in the figures, and a seatback driving component 1B3. The two seatback engaging components 1B1 are respectively movably disposed on two lateral sides of the seatback 13, and the plurality of seatback engaging slot structures 1B2 are formed on the two lateral sides of the booster seat 11. The seatback driving component 1B3 is movably disposed on a rear side of the seatback 13 for driving the two seatback engaging components 1B1 to respectively engage with or disengage from the two corresponding seatback engaging slot structures 1B2. The seatback resilient component biases the seatback driving component 1B3 to drive the two seatback engaging components 1B1 to respectively engage with the two corresponding seatback engaging slot structures 1B2.

When it is desired to adjust a position of the seatback 13 relative to the booster seat 11, the seatback driving component 1B3 can be operated to drive the two seatback engaging components 1B1 to respectively disengage from the two corresponding seatback engaging slot structures 1B2 for allowing the rotary movement of the seatback 13 relative to the booster seat 11. When adjustment of the seatback 13 is completed, the seatback driving component 1B3 can be released to engage the two seatback engaging components 1B1 with the two corresponding seatback engaging slot structures 1B2 to position the seatback 13.

Furthermore, the seatback resilient component can preferably be an elastic spring or torsional spring. However, the present invention is not limited thereto.

In contrast to the prior art, the present invention allows a caregiver to switch the child carrier among the high chair mode, the youth chair mode and the booster mode by detaching the lower support only or detaching the upper supports together with the lower supports, so as to position the booster seat at different desired heights. Besides, the present invention further allows the caregiver to install or remove at least one of the seatback, the tray and the leg rest to provide different features to satisfy the child's needs no matter when the child carrier is in the high chair mode, the youth chair mode or the booster mode. Therefore, the present invention is not only user-friendly but also flexible in use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A child carrier comprising:

a booster seat, at least one socket being formed on the booster seat; and a leg assembly detachably installed on the booster seat, the leg assembly comprising:

at least one upper support detachably installed on the booster seat, the at least one upper support being a pipe-shaped structure, an upper end of the at least one upper support being inserted into the at least one socket when the at least one upper support is installed on the booster seat; and at least one lower support detachably installed on the at least one upper support;

wherein the child carrier is in a high chair mode when the at least one lower support and the at least one upper support are respectively installed on the at least one upper support and the booster seat to connect the leg assembly to the booster seat, the child carrier is in a youth chair mode when the at least one upper support is installed on the booster seat and the at least one lower support is detached from the at least one upper support, and the child carrier is in a booster mode when the at least one upper support is detached from the booster seat to separate the leg assembly from the booster seat.

2. The child carrier of claim 1, wherein the at least one lower support comprises at least one first segment and at least one second segment detachably installed on the at least one first segment.

3. The child carrier of claim 2, wherein the leg assembly further comprises at least one wheel rotatably disposed on the at least one second segment.

4. The child carrier of claim 2, wherein the at least one second segment comprises two second segments, and the two second segments are connected to each other to cooperatively form a U-shaped structure.

5. The child carrier of claim 2, further comprising a releasing module for allowing or restraining at least one of movement of the at least one second segment relative to the at least one first segment, movement of the at least one lower support relative to the at least one upper support and movement of the at least one upper support relative to the booster seat.

6. The child carrier of claim 1, further comprising a leg rest detachably installed on the at least one upper support and a leg rest releasing assembly for allowing or restraining movement of the leg rest relative to the at least one upper support.

7. The child carrier of claim 1, further comprising a tray detachably installed on the booster seat and a tray releasing assembly for allowing or restraining movement of the tray relative to the booster seat.

8. The child carrier of claim 1, further comprising a seatback detachably installed on the booster seat.

9. The child carrier of claim 8, wherein the seatback is rotatable relative to the booster seat.

10. The child carrier of claim 9, wherein the seatback comprises at least one pivoting protrusion and at least one retaining rib, at least one first slot and at least one second slot communicated with the at least one first slot are formed on the booster seat, the at least one pivoting protrusion and the at least one retaining rib are accommodated in the at least one first slot when the seatback is located at an unused position relative to the booster seat, and the at least one pivoting protrusion and at least a portion of the at least one retaining rib are respectively accommodated in the at least one first slot and the at least one second slot when the seatback is located at a used position relative to the booster seat.

11. The child carrier of claim 10, wherein the at least one pivoting protrusion is a cylinder-shaped structure.

12. The child carrier of claim 10, wherein the at least one retaining rib is an arc-shaped structure.

13. The child carrier of claim 9, further comprising a seatback releasing assembly for allowing or restraining a rotary movement of the seatback relative to the booster seat.

14. The child carrier of claim 8, further comprising a seatback restraining assembly for allowing or restraining separation of the seatback and the booster seat.

15. A child carrier comprising:

a booster seat being a one-piece molded structure, at least one socket being formed on the booster seat; and a leg assembly detachably installed on the booster seat, the leg assembly comprising:

at least one upper support detachably installed on the booster seat, the at least one upper support being a pipe-shaped structure, an upper end of the at least one upper support being inserted into the at least one socket when the at least one upper support is installed on the booster seat; and at least one lower support detachably installed on the at least one upper support;

wherein the child carrier is in a high chair mode when the at least one lower support and the at least one upper support are respectively installed on the at least one upper support and the booster seat to connect the leg assembly to the booster seat, the child carrier is in a youth chair mode when the at least one upper support is installed on the booster seat and the at least one lower support is detached from the at least one upper support, and the child carrier is in a booster mode when the at least one upper support is detached from the booster seat to separate the leg assembly from the booster seat.

* * * * *